United States Patent [19]

Asayama

[11] 4,455,985

[45] Jun. 26, 1984

[54] ELECTRONIC CONTROL TYPE FUEL INJECTION APPARATUS

[75] Inventor: Yoshiaki Asayama, Himeji, Japan

[73] Assignee: Mitsubishi Denki Kabushiki Kaisha, Tokyo, Japan

[21] Appl. No.: 532,300

[22] Filed: Sep. 15, 1983

Related U.S. Application Data

[63] Continuation of Ser. No. 244,094, Mar. 16, 1981, abandoned.

[30] Foreign Application Priority Data

Mar. 14, 1980 [JP] Japan ..... 55-32895

[51] Int. Cl.[3] ..... F02B 51/04

[52] U.S. Cl. ..... 123/494; 123/478

[58] Field of Search ..... 123/494, 478, 480, 482, 123/488, 497, 492, 493, 505, 277

[56] References Cited

U.S. PATENT DOCUMENTS

| | | | |
|---|---|---|---|
| 3,967,596 | 7/1976 | Comley | 123/494 |
| 3,982,503 | 9/1976 | Keranen | 123/494 |
| 4,150,647 | 4/1979 | Suzuki et al. | 123/494 |
| 4,205,377 | 5/1980 | Oyama et al. | 123/494 |
| 4,217,863 | 8/1980 | Ezoe | 123/494 |
| 4,228,768 | 10/1980 | Kita | 123/494 |
| 4,250,745 | 2/1981 | Blotter et al. | 123/494 |
| 4,263,884 | 4/1981 | Suzuki et al. | 123/494 |

*Primary Examiner*—Raymond A. Nelli

*Attorney, Agent, or Firm*—Oblon, Fisher, Spivak, McClelland & Maier

[57] ABSTRACT

An electronic control type fuel injection apparatus comprises a vortex air-flow meter for sensing a suction air-flow rate by generating a frequency output depending upon a vortex air-flow rate depending upon a suction air-flow rate of air fed into an internal combustion engine; a control device for injecting the fuel by actuating an electromagnetic valve for a specific period under substantially synchronizing to the frequency output of said vortex air-flow meter; an air-cleaner placed in the upper-stream of said vortex air-flow meter; and a pressure sensor for sensing variation of pressure of the suction air fed into said vortex air-flow meter which is caused by said air-cleaner, whereby periods for actuating said electromagnetic valve are controlled depending upon the output of said pressure sensor.

3 Claims, 2 Drawing Figures

ELECTRONIC CONTROL TYPE FUEL INJECTION APPARATUS

This application is a continuation of application Ser. No. 244,094, filed Mar. 16, 1981 now abandoned.

BACKGROUND OF THE INVENTION

1. Field of the Invention

The present invention relates to an electronic control type fuel injection apparatus for an internal combustion engine for a car. More particularly, it relates to an improvement of an electronic control fuel injection apparatus for an internal combustion engine which comprises a vortex air-flow meter for sensing a suction air-flow rate fed into the engine and a control device for actuating an electromagnetic valve for periods under synchronizing a frequency output of the vortex air-flow meter to inject the fuel for each specific period.

2. Description of the Prior Arts

As it is well-known, a vortex air-flow meter provides an output of frequency corresponding to vortex air-flow rate (vortex number ratio) which is proportional to the measured volumetric suction air-flow rate. In the conventional electronic control type fuel injection apparatus for the internal combustion engine for a car which feeds the fuel into the engine at a specific fuel rate under synchronizing to the frequency output being proportional to the volumetric air-flow rate, it is preferable to keep constant of the pressure in the upper-stream of the vortex air-flow meter. In usual, however, an air-cleaner and a suction air conduit are equipped in the upper-stream of the vortex air-flow meter. It is difficult to keep constant of the pressure in practice because of the pressure drop caused by the air-cleaner and the air conduit.

SUMMARY OF THE INVENTION

It is an object of the present invention to overcome the disadvantages of the conventional apparatus and to provide an electronic control type fuel injection apparatus which controls periods for actuating an electromagnetic valve for fuel injection depending upon variation of a pressure in the upper-stream of a vortex air-flow meter to be capable of calibrating the pressure of the vortex air-flow meter.

The foregoing and other objects of the present invention have been attained by providing an electronic control type fuel injection apparatus which comprises a vortex air-flow meter for sensing a suction air-flow rate by generating a frequency output depending upon a vortex air-flow rate depending upon a suction air-flow rate of air fed into an internal combustion engine; a control device for injecting the fuel by actuating an electromagnetic valve for a specific period under substantially synchronizing to the frequency output of said vortex air-flow meter; and air-cleaner placed in the upper-stream of said vortex air-flow meter; and a pressure sensor for sensing variation of pressure of the suction air fed into said vortex air-flow meter which is caused by said air-cleaner, whereby periods for actuating said electromagnetic valve are controlled depending upon the output of said pressure sensor.

DETAILED DESCRIPTION OF THE PREFERRED EMBODIMENTS

Figure 1:
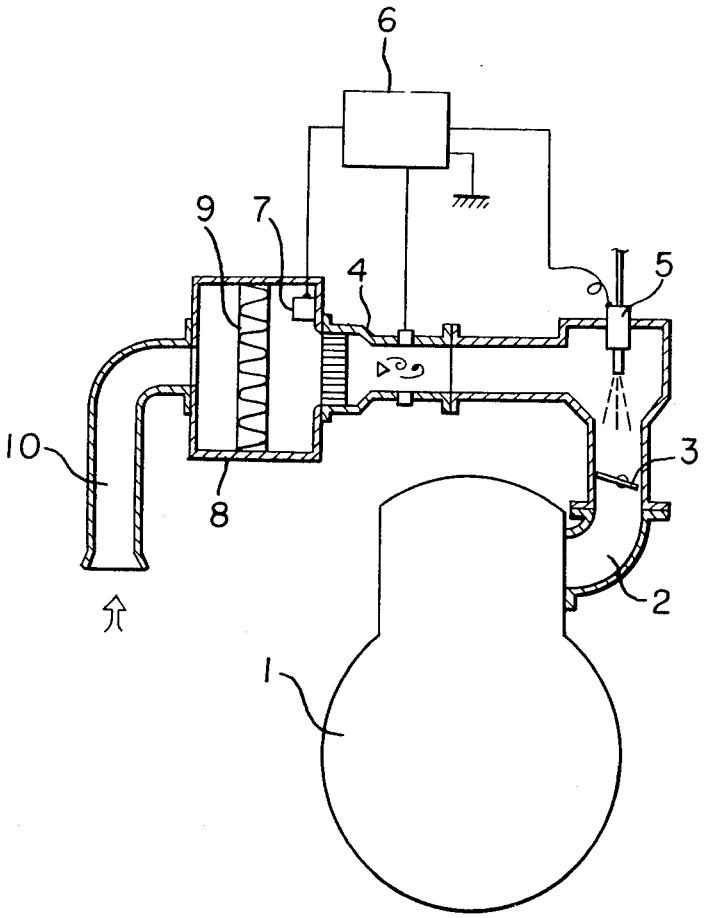
FIG. 1 is a schematic view of one embodiment of an electronic control type fuel injection apparatus.

Referring to the drawing, one embodiment of the present invention will be illustrated. In the drawing, the reference numeral (1) designates an internal combustion engine; (2) designates a suction pipe of the engine (1); (3) designates a throttle valve interconnected to an accelerator pedal of a car; (4) designates vortex air-flow meter for sensing a suction air-flow rate of air sucked into the engine (1); and (5) designates an electromagnetic valve for fuel injection placed in the upper-stream of the throttle valve and a fuel pressurized by a fuel pump (not shown) is injected into the suction pipe (2) of the engine under synchronizing to a frequency output corresponding to vortex frequency of the vortex air-flow meter (4). The reference numeral (6) designates an electronic control device for controlling injection timing and injection period of the electromagnetic valve for fuel injection; (7) designates a pressure sensor for sensing pressure in the upper-stream of the vortex air-flow meter (4); (8) designates an air-cleaner placed in the upper-stream of the vortex air-flow meter (4); (9) designates a cleaner element (filter paper) held inwardly in the air-cleaner; (10) designates a suction air conduit for feeding air placed in the upper-stream of the air-cleaner (8).

The operation of the apparatus having the structure will be illustrated.

When the internal combustion engine is started, air is sucked from the suction air conduit (10), through the air-cleaner (8) into the vortex air-flow meter (4) to sense the suction air-flow rate by the air-flow meter. The air is fed into the suction pipe (2) of the engine (1). When the suction air-flow rate increases, the pressure of the suction air passing through the vortex air-flow meter (4) is remarkably decreased by the air-cleaner (8). As it is well known, such vortex air-flow meter senses the volumetric air-flow rate. Thus, when the pressure remarkably decreases, the volume is increased so as to increase the output of the vortex air-flow meter. On the other hand, an air-fuel ratio of the internal combustion engine is a weight ratio. Thus, if the fuel is injected under synchronizing to the output frequency of the vortex air-flow meter (4) under the condition of pressure drop, the fuel injection rate is increased to cause excess fuel injection. (In an internal combustion engine of 2000 cc, 3 to 8% of excess fuel feeding is found in the maximum output). Thus, in a volumetric air-flow meter as the vortex air-flow meter, it is necessary to calibrate the pressure drop. Especially, a shape and a length of the suction air conduit (10) of the internal combustion engine for a car are different depending upon kinds of the car. Moreover, a length of the suction air conduit (10) should be long in view of silence, and water-proof. Therefore, the pressure drop in the upper-stream of the vortex air-flow meter (4) is great.

In accordance with the embodiment of the present invention, the pressure drop is sensed by the pressure sensor (7) and the output signal thereof is fed to the electronic control device (6), whereby the periods for actuating the electromagnetic valve (5) for fuel injection are controlled depending upon the output signal of the pressure sensor to calibrate them. The excess fuel feeding condition can be eliminated to be capable of controlling the fuel injection rate depending upon the precise air-fuel ratio.

In the embodiment, if the pressure sensor (7) has a structure for sensing absolute pressure, the output depending upon both of the pressure drop and the variation of the atmospheric pressure can be given to be capable of calibrating the atmospheric pressure at high place.

Figure 2:
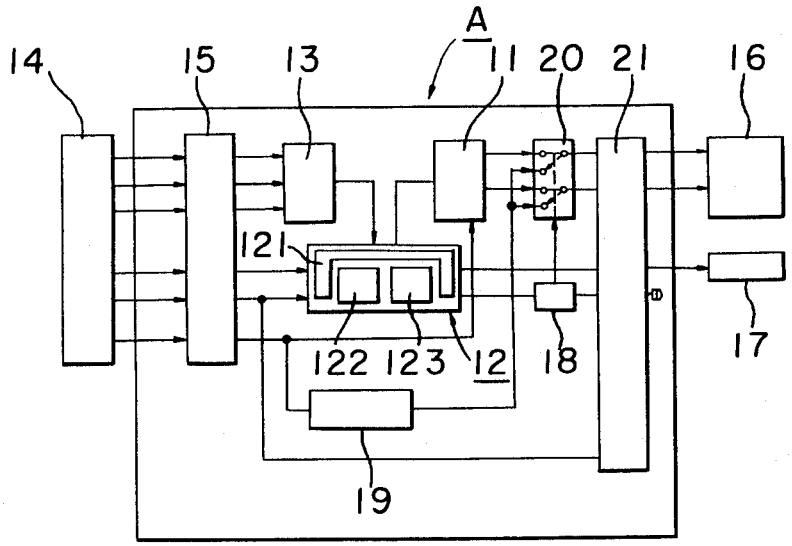
FIG. 2 is a circuit diagram of one embodiment of an electronic control device.

Referring to FIG. 2, one embodiment of the electronic control device (6) for controlling injection timing and injection period of the electromagnetic valve for fuel injection, will be illustrated.

The electronic control device can be a simple computer unit (A) such as 8 bits 1 chip microcomputer. ROM has a program of calibration for calculating a fuel feed rate and an optimum data for the operation. A timer IC (11) for converting digital data corresponding to the calculated fuel feed rate into an injector actuating period is connected to the microcomputer (12) comprising IC (121), CPU (122) and memory (123). An A/D converter (13) for converting analog data into digital data is also connected to the microcomputer (12).

The data of sensors (14) equipped with the engine are passed through an input interface circuit (15) to eliminate noise and then, the analog data are passed to the A/D converter (13). The digital data such as switches are passed directly to the microcomputer (12). In the microcomputer, the desired fuel feed rate is calculated to write in a registor in the timer IC which is operated as the programable one shot function to generate an injector actuating pulse having width proportional to the write-in data. In order to synchronize the actuation of the injector (16) to the output frequency of the air flow sensor, an air flow sensor output signal is connected to the trigger input of the timer (11). The microcomputer is operated with data such as a suction air rate, an engine revolution number, a coolant water temperature etc, an EGR control solenoid (17) is actuated to control the valve. A watch-dog circuit (18) can be connected for a failure of the microcomputer. An output of the back-up circuit (19) is selected by a selector (20) to actuate the injector (16) so as to maintain the driving in the failure of the microcomputer (12). The reference (21) designates a driving circuit.

In accordance with the present invention, a pressure sensor for sensing the pressure variation of the suction air fed into the vortex air-flow meter for sensing a suction air-flow rate of the internal combustion engine is equipped to control the periods for actuating the electromagnetic valve for fuel injection depending upon the output of the pressure sensor. Therefore, it provides the fuel injection apparatus wherein the pressure calibration of the vortex air-flow meter can be easily given and the fuel is fed at a precise air-fuel ratio without any adverse effect of the length and the shape of the air-cleaner or the suction air conduit.

Examples of circuits in the prior art which can be used to implement the back-up circuit (19) above noted are evident in the following U.S. Pat. Nos. 3,578,958 to Richardson; 3,834,361 to Keely; 4,133,027 to Hogan; 4,141,066 to Keiles; and 4,328,527 to Barman et al. With the exception of the above-noted Richardson patent, each of the remaining patents and also U.S. Pat. No. 3,786,433 to Notley et al. discloses a circuit comparable to the watch-dog circuit (18) shown schematically in FIG. 2.

What is claimed is:

1. An electronic control type fuel injection apparatus which comprises:

a vortex air-flow meter for sensing a suction air-flow rate of air fed into an internal combustion engine and for generating a frequency output indicative of a vortex air-flow rate depending upon a suction air-flow rate sensed by the vortex air-flow meter;

a control device for controlling injecting of fuel, including an electromagnetic valve, and means for actuating said valve for a specific period substantially in synchronization with the frequency output of said vortex air-flow meter;

an air-cleaner placed upstream of said vortex air-flow meter; and a pressure sensor for sensing variation of pressure of the section air fed into said vortex air-flow meter, which is caused by said air-cleaner;

wherein said actuating means controls commencement of actuation of said valve based on the frequency output of said vortex air-flow meter independent of engine speed and controls and duration of actuation of said valve based on the output of said pressure sensor.

2. The electronic control type fuel injection apparatus according to claim 1 wherein said air-cleaner is equipped with a suction air conduit in the upper-stream of said air-cleaner and said pressure sensor also senses pressure variation caused by said air conduit.

3. The electronic control type fuel injection apparatus according to claim 1 or 2 wherein said pressure sensor is a device for sensing an absolute pressure to sense both of said pressure variation and variation of the atmospheric pressure.

* * * * *